US006607994B2

(12) United States Patent
Soane et al.

(10) Patent No.: US 6,607,994 B2
(45) Date of Patent: Aug. 19, 2003

(54) NANOPARTICLE-BASED PERMANENT TREATMENTS FOR TEXTILES

(75) Inventors: David S. Soane, Piedmont, CA (US); David A. Offord, Castro Valley, CA (US); Matthew R Linford, Orem, UT (US); Dan B. Millward, Alameda, CA (US); William Ware, Jr., Palo Alto, CA (US); Lael Erskine, Fremont, CA (US); Eric Green, Oakland, CA (US); Ryan Lau, Berkeley, CA (US)

(73) Assignee: Nano-Tex, LLC, Emeryville, CA (US)

( * ) Notice: Subject to any disclaimer, the term of this patent is extended or adjusted under 35 U.S.C. 154(b) by 53 days.

(21) Appl. No.: 09/731,431

(22) Filed: Dec. 6, 2000

(65) Prior Publication Data

US 2003/0013369 A1 Jan. 16, 2003

Related U.S. Application Data

(63) Continuation-in-part of application No. PCT/US00/40428, filed on Jul. 19, 2000.

(60) Provisional application No. 60/176,946, filed on Jan. 18, 2000, provisional application No. 60/153,392, filed on Sep. 10, 1999, provisional application No. 60/144,615, filed on Jul. 20, 1999, and provisional application No. 60/144,485, filed on Jul. 19, 1999.

(51) Int. Cl.[7] ..... B32B 27/04; B32B 19/04; B32B 5/16

(52) U.S. Cl. ..... 442/59; 428/402; 428/402.2; 428/402.21; 428/402.24; 428/403; 428/407; 442/96; 442/97; 442/102; 442/123; 442/124; 442/125; 442/132; 442/133; 442/136; 442/153

(58) Field of Search ..... 428/357, 402–407, 428/323, 324, 327, 404–406; 442/69, 74, 96, 97, 101–108, 123, 131, 136, 152–158, 164–174, 181, 267, 281, 284, 285, 294, 304, 322, 325, 375, 59, 124, 125, 132, 133

(56) References Cited

U.S. PATENT DOCUMENTS

| | | | | | |
|---|---|---|---|---|---|
| 3,069,370 | A | | 12/1962 | Jensen et al. | |
| 3,653,952 | A | * | 4/1972 | Gagliardi | 117/126 |
| 3,712,867 | A | | 1/1973 | Schon et al. | 252/316 |
| 3,801,379 | A | | 4/1974 | Blackwell | 148/6.27 |
| 3,864,275 | A | | 2/1975 | Kan et al. | 252/316 |
| 3,875,074 | A | | 4/1975 | Vassiliades et al. | 252/316 |
| 3,891,570 | A | | 6/1975 | Fulushima et al. | 252/316 |
| 3,919,110 | A | | 11/1975 | Vassiliades et al. | 252/316 |
| 4,089,699 | A | | 5/1978 | Blackburn et al. | 106/308 |
| 4,119,565 | A | | 10/1978 | Baatz et al. | 252/316 |
| 4,124,734 | A | * | 11/1978 | Alterman et al. | 111/978 |
| 4,154,462 | A | * | 5/1979 | Golden et al. | 503/209 |
| 4,421,660 | A | | 12/1983 | Hajna | 252/62.54 |
| 4,665,107 | A | * | 5/1987 | Micale | 523/105 |
| 4,882,220 | A | * | 11/1989 | Ono et al. | 442/96 |
| 4,961,755 | A | | 10/1990 | Bruttel et al. | 8/526 |
| 4,981,882 | A | | 1/1991 | Smith et al. | 523/205 |
| 5,134,223 | A | | 7/1992 | Langer et al. | 528/272 |
| 5,185,169 | A | | 2/1993 | Yamamoto | 427/246 |
| 5,190,586 | A | | 3/1993 | Mizuguchi et al. | 106/499 |
| 5,378,755 | A | * | 1/1995 | Krishnan et al. | 524/555 |
| 5,534,585 | A | | 7/1996 | Roulstone et al. | 524/497 |
| 5,543,083 | A | | 8/1996 | Sivik et al. | 252/403 |
| 5,641,561 | A | * | 6/1997 | Hansen et al. | 442/417 |
| 5,698,183 | A | | 12/1997 | Langer et al. | 424/59 |
| 5,705,474 | A | | 1/1998 | Severns et al. | 510/500 |
| 6,015,570 | A | * | 1/2000 | Tucci et al. | 424/403 |
| 6,225,372 | B1 | * | 5/2001 | Lykke et al. | 523/201 |

FOREIGN PATENT DOCUMENTS

| | | | |
|---|---|---|---|
| EP | 0 303 803 | 6/1988 | |
| EP | 0 542 133 | 11/1992 | |
| FR | 0 598 091 | * 6/1992 | C08F/2/24 |
| FR | 2 761 886 | 10/1998 | |

OTHER PUBLICATIONS

PCT International Search Report, dated Nov. 30, 2000, mailed Dec. 13, 2000 for PCT/00US/40428.

Nelson, G., *Review of Progress in Coloration and Related Topics*, 1991, 21: 72–85.

Chem. Abstracts, No. 170671 (Nov. 30, 1996).

* cited by examiner

*Primary Examiner*—Cheryl A. Juska
*Assistant Examiner*—Lynda Salvatore
(74) *Attorney, Agent, or Firm*—Jacqueline S. Larson

(57) ABSTRACT

This invention is directed to preparations useful for the permanent or substantially permanent treatment of textiles and other webs. More particularly, the preparations of the invention comprise an agent or other payload surrounded by or contained within a polymeric encapsulator that is reactive to webs, to give textile-reactive nanoparticles. By "textile-reactive" is meant that the payload nanoparticle will form a chemical covalent bond with the fiber, yarn, fabric, textile, finished goods (including apparel), or other web or substrate to be treated. The polymeric encapsulator of the payload nanoparticle has a surface that includes functional groups for binding or attachment to the fibers of the textiles or other webs to be treated, to provide permanent attachment of the payload to the textiles. Alternatively, the surface of the nanoparticle includes functional groups that can bind to a linker molecule that will in turn bind or attach the nanoparticle to the fiber. This invention is further directed to the fibers, yarns, fabrics, other textiles, or finished goods treated with the textile-reactive nanoparticles. Such textiles and webs exhibit a greatly improved retention or durability of the payload agent and its activity, even after multiple washings.

17 Claims, No Drawings

NANOPARTICLE-BASED PERMANENT TREATMENTS FOR TEXTILES

This application is a continuation-in-part of copending International Application No. PCT/US00/40428, filed on Jul. 19, 2000 and designating the United States of America, which application claims benefit of U.S. provisional application Ser. Nos. 60/176,946, filed Jan. 18, 2000, 60/153,392, filed Sep. 10, 1999; 60/144,615, filed Jul. 20, 1999; and 60/144,485, filed Jul. 19, 1999; the entire disclosures of all of which are incorporated herein by reference.

FIELD OF THE INVENTION

This invention is directed to the field of fabric and textile treatments. More specifically, this invention relates to preparations and their use in providing substantially permanent desirable characteristics to textiles.

BACKGROUND OF THE INVENTION

Fabric treatments endowing particular characteristics or activity are highly desired by the apparel, home furnishings, and medical industries. However, conventional processes used to impart such characteristics often do not lead to permanent effects. Laundering or wearing of the treated fabric causes leaching or erosion of the agents responsible for imparting the desired characteristics. This deficiency has resulted in research efforts to develop durable treatments. Chemical bonding of the compounds onto the fabrics enhances their durability. Unfortunately, the required chemical modifications often cause concomitant reduction or loss of activity or other desired characteristics and must be individually developed for the different agents on a case-by-case basis. Labile or hydrolyzable linkers for direct chemical attachment or controlled release are difficult to engineer; they possess decomposition kinetics which are generally difficult to control, and they must be individually developed for the different fabrics and treatments on a case-by-case basis.

There is thus a need for a robust and precisely controllable methodology to durably attach agents to fibers, yarns, fabrics, and/or textiles (webs), without impairing the desired characteristics of the agent. Furthermore, for certain situations, there is a need to control the release of the agents over a prolonged duration (e.g., fragrances, biocides, antifungals, etc.).

SUMMARY OF THE INVENTION

This invention is directed to preparations useful for the permanent or substantially permanent treatment of various types of textile materials and other substrates and webs. More particularly, the preparations of the invention comprise an agent or other payload that is surrounded by or contained within a synthetic polymer shell or matrix or that has a surface coating. The shell, matrix or coating is reactive to fibers, yarns, fabrics, or webs, thus providing textile-reactive beads or matrices. The beads or matrices are micrometric or nanometric in size, and are herein referred to as "nanoparticles". The nanoparticle of the invention may comprise a polymeric shell surrounding the payload, a three-dimensional polymeric network entrapping the payload, or a reactive surface coating, all of which are encompassed under and referred to herein and in the appended claims as a "polymeric encapsulator". By "textile-reactive" is meant that the payload nanoparticle will form a strong chemical bond with the fiber, yarn, fabric, textile, finished goods (including apparel), or other web or substrate to be treated.

The polymeric encapsulator has a surface that includes functional groups that bind to the fibers, filaments or structural components or elements (referred to collectively herein and in the appended claims as "fibers") of the treated textiles or other webs, thus providing permanent attachment of the payload to the fibers. Alternatively, the polymeric encapsulator includes functional groups that can bind to a linker molecule or polymer, which in turn will bind or attach the nanoparticle to the fiber. In either case, these functional groups are referred to herein as "textile-reactive functional groups" or "fiber-reactive functional groups" or "substrate-reactive functional groups".

The terms "payload" and "payload agent" as used herein refer collectively to any material or agent that would be desirable for permanent attachment to or treatment of a textile or other web. Alternatively, the payload agent may be released from the cage of the payload nanoparticle in a controlled and/or prolonged fashion.

The chemical linkages on the surface of the nanoparticles do not involve the molecules of the payload. In many cases, in particular that of payload release, the payload agents are physically entrapped within the nanoparticle and require no chemical modifications of the agents themselves. The resulting nanoparticles have improved retention within and on the textile or web fiber structure without changing the inherent character of the payload agent. In other cases, the payload agents do not have inherent reactivity with fibers. In these cases, the polymeric encapsulator binds the payload to the fiber by chemical reaction with the fiber and either chemical binding or physical encapsulation of the payload agent.

The architecture of the polymeric encapsulator of the nanoparticle can be formulated and fine-tuned to exhibit controlled release of the entrapped payload, ranging from constant but prolonged release (desirable for drugs, biologic or anti-biologic agents, softeners, and fragrances, for example) to zero release (desirable for dyes, metallic reflector colloids, and sunblock agents, for example). In an encapsulated configuration, the nanoparticles will desirably insulate the payload from the skin, preventing potential allergic reactions. In addition, the nanoparticle can be designed to respond to different environmental stimuli (such as temperature, light change, pH, or moisture) to increase the rate of release, or color change at certain times or in certain selected spots or locations on the textile or finished good.

This invention is further directed to the fibers, yarns, fabrics (which may be woven, knitted, stitch-bonded or nonwoven), other textiles, or finished goods (encompassed collectively herein under the terms "textiles" or "webs") treated with the textile-reactive nanoparticles. Such textiles and webs exhibit a greatly improved retention or durability of the payload agent and its activity, even after multiple washings.

Methods are provided for synthesizing a textile-reactive payload-containing nanoparticle. The preparations of the invention may be formed via one of several methods of encapsulation, such as interfacial polymerization, microemulsion polymerization, precipitation polymerization, surface coating, and diffusion. Multi-component mixture preparation followed by atomization/spraying into a drying chamber is yet another processing scheme. Reactive functional groups on the polymeric encapsulator provide a means for attaching the payload nanoparticles to textiles.

DETAILED DESCRIPTION OF THE INVENTION

The textile-reactive preparations of the invention comprise an agent or payload surrounded by or contained within a polymeric encapsulator that is reactive to textiles or other webs, thus providing textile-reactive payload nanoparticles. The polymeric encapsulator of the nanoparticle has a surface that includes functional groups for binding or attachment to the fibers of the textiles or other webs to be treated.

The terms "payload" and "payload agent" as used herein refer collectively to any material or agent that would be desirable for permanent or semi-permanent attachment to or treatment of a textile or other web. The payload may include, but is not limited to the following: bioactive or anti-microbial/fungal agents, drugs and pharmaceuticals, sun-block agents, dyes (such as iridescent dyes, fixed dyes, and dyes that respond to a particular environmental or chemical trigger such as heat, pH, carbon monoxide, sulfuric acid, or minute quantities of blood, for example), pigments, scents and fragrances, fire retardant or suppressant chemicals, metallic reflector colloids, reflective particles (such as mica), magnetic particles, thermochromic materials, insect repellents, heat-absorbing or -releasing phase change agents, fabric softeners, zeolites and activated carbon (useful for absorbing environmental hazards such as toxins and chemicals including formaldehyde). While the following discussions herein are directed to certain exemplary agents, it is important to note that other materials having any desirable activity suitable for textile treatments may also be encapsulated according to the teachings herein and are included within the scope of this invention.

The nanoparticles of the invention are formed by contacting an agent or other payload with a set of monomers, oligomers, or polymers (referred to herein as a "polymeric set"). The monomers, oligomers, or polymers assemble around the payload. The polymeric set is then polymerized around the payload. In some cases the polymeric set will bind directly to the payload. The result is a polymeric encapsulator surrounding the payload agent. The polymeric set includes at least some components that provide reactive "hooks" or functional groups on the surface of the final polymeric nanoparticle, which will bind, either directly or via linker molecules or polymers, to the textile structural members or web fibers to be treated.

Alternatively, a nanoparticle having functional groups on its surface can first be prepared by polymerizing a polymeric set, after which a payload can be exposed to the nanoparticle under suitable conditions such that the payload is absorbed into and entrapped in the polymeric network, to provide the textile-reactive payload nanoparticle of the invention.

Particular monomers, oligomers, or polymers useful in forming the nanoparticles of the present invention are those that contain amine, hydroxyl, sulfhydryl, or haloalkyl monomers or polymers combined with amine-, hydroxyl-, sulfhydryl-, or haloalkyl-reactive monomers or polymers. Specific examples include, but are not limited to, monomers or polymers of maleic anhydride and a di- or polyamine (monomer or polymer), and functionalized alkoxy- and halo-silanes. Presently preferred monomers are anhydrides and alkoxy- and halo-silanes. Other free-radical polymerizable reactive groups that can be used are acrylates, methacrylates, vinyl ethers, esters of maleic acid, butadiene and its derivatives, acrylamides, etc. Examples of hydrophilic and hydrophobic monomers are listed below. Many of these monomers are commercially available, for example from Polysciences, Inc., Warrington, Pa.

Hydrophobic Monomers

N-(tert-Butyl)acrylamide
n-Decyl acrylamide
n-Decyl methacrylate
N-Dodecylmethacrylamide
2-Ethylhexyl acrylate
1-Hexadecyl methacrylate
n-Myristyl acrylate
N-(n-Octadecyl) acrylamide
n-Octadecyltriethoxysilane
N-tert-Octylacrylate
Stearyl acrylate
Stearyl methacrylate
Vinyl laurate
Vinyl stearate
Bromopropyltrichorosilane Hydrophobic Monomers—Fluorinated 1H,1H,7H-Dodecafluoroheptyl methacrylate
2-Fluorostyrene
4-Fluorostyrene
1H,1H,2H,2H-Heptadecafluorodecyl acrylate
1H 1H,2H,2H-Heptadecafluorodecyl methacrylate
1H,1H-Heptafluorobutyl acrylate
1H,1H-Heptafluorobutyl methacrylate
1H,1H,4H-Hexafluorobutyl acrylate
1H,1H,4H-Hexafluorobutyl methacrylate
Hexafluoro-iso-propyl acrylate
Methacryloyl fluoride
1H,1H-Pentadecafluorooctyl acrylate
1H,1H-Pentadecafluorooctyl methacrylate
Pentafluorophenyl acrylate
Pentafluorophenyl methacrylate
2,3,4,5,6-Pentafluorostyrene
1H,1H,3H-Tetrafluoropropyl acrylate
1H,1H,3H-Tetrafluoropropyl methacrylate
2,2,2-Trifluoroethyl acrylate
2,2,2-Trifluoroethyl methacrylate Hydrophilic Monomers Acrylamide
Acrylic acid
N-Acryloyltris(hydroxymethyl)methylamine
Bisacrylamidoacetic acid
Glycerol mono(meth)acrylate
4-Hydroxybutyl methacrylate
2-Hydroxyethyl acrylate
2-Hydroxyethyl methacrylate (glycol methacrylate)
N-(2-Hydroxypropyl)methacrylamide
N-Methacryloyltris(hydroxymethyl)methylamine
N-Methylmethacrylamide
Poly(ethylene glycol) (n) monomethacrylate
Poly(ethylene glycol) (n) monomethyl ether monomethacrylate
2-Sulfoethyl methacrylate
1,1,1-Trimethylolpropane monoallyl ether
N-Vinyl-2-pyrrolidone (1-vinyl-2-pyrrolidinone)
3-aminopropyltriethoxysilane
Poly(ethylenimine)

The monomers, oligomers, or polymers may optionally be copolymerized with soft or rubbery (elastomeric) monomers or polymers to impregnate and thereby increase the durable press properties, to add to the softness, and/or to aid in the resistance to abrasive wear of the treated fabric. Alternatively, the textile-reactive nanoparticles may be applied to the fabric in conjunction with such soft or rubbery (elastomeric) monomers or polymers. The rubbery groups are selected from those groups that will provide the necessary degree of wrinkle resistance, softness, durability, strength, and abrasion resistance. Examples include, but are not limited to, polymers of isoprene, chloroprene, and polymers such as polydimethylsiloxane, polyisobutylene, polyalt-styrene-co-butadiene, poly-random-styrene-co-butadiene, polyethylene glycol, polypropylene glycol, and copolymers of all of these.

The textile-reactive hooks or functional groups on the surface of the textile-reactive nanoparticles are selected from those groups that will bind chemically with a particular structural element, fiber, yarn, fabric, or finished good. For example, all cellulosic-based webs contain hydroxyl groups. Wool and other proteinaceous animal fibers, silk, and regenerated proteins contain hydroxyl, amine, carboxylate, and thiol groups (the latter as disulfides). It is desirable for the reactive monomers to contain functional groups that are reactive to the fiber. For example, the reactive monomers may contain adjacent carboxyl groups that can form five- and six-membered cyclic anhydrides. The anhydrides form with the aid of a catalyst when the reactive monomer is heated and dried. These cyclic anhydrides react with fibers that contain hydroxyls or amines (e.g. cotton or wool). Alternatively, the reactive groups may contain epoxide groups or epoxide precursors, such as halohydrins. Epoxides can react with amines and hydroxyls. Also, methylolacrylamide (methylol groups are known to react with cotton, e.g. DMDHEU) may be copolymerized into the nanoparticle matrix. Anhydride groups are presently preferred.

Specific amine-reactive groups include isothiocyanates, isocyanates, acyl azides, N-hydroxysuccinimide esters, sulfonyl chlorides, aldehydes, glyoxals, epoxides, oxiranes, carbonates, arylating agents, imidoesters, carbodiimides, anhydrides, and halohydrins. Carboxylate-reactive groups include diazoalkanes and diazoacetyl compounds, carbonyl diimidazole, and carbodiimides. Hydroxyl-reactive functional groups include epoxides, oxiranes, carbonyl diimidazole, N,N'-disuccinimidyl carbonate or N-hydroxysuccinimidyl chloroformate, alkyl halides, isocyanates, and halohydrins. Hydroxyl groups may also be oxidized enzymatically or with periodate. Thiol groups react with haloacetyl and alkyl halide derivatives, maleimides, aziridines, acryloyl derivatives, arylating agents, and thiol-disulfide exchange reagents such as pyridyl disulfides, disulfide reductants, and 5-thio-2-nitrobenzoic acid.

Alternatively, the payload nanoparticle has surface functional groups that will react with linker molecules, which linkers will then attach to the fiber or textile to be treated. These linker molecules may be polymers. Each linker molecule may have more than one type of functional group, but at least one of the types of functionality will belong to the fiber-reactive groups listed vide supra. The linkers may be grafted onto the payload nanoparticles prior to treatment of the textile, or they may be an individual component of the applied formulation. In the latter case, the linkers will bind to both the nanoparticles and the fibers during the curing process. In one embodiment of the invention, the encapsulated payload nanoparticles are attached via their surface functional groups to N-methylol resin compounds. These N-methylol compounds are covalently attached to the textile or web. The N-methylol-containing compounds thus act as attachment bridges or linkers between the payload nanoparticles and the textile. In the practice of the invention, the N-methylol compound may react first with either the fabric or the payload nanoparticle. An additional advantage is that the N-methylol-containing compound, when present in an appropriate amount (the manufacturer recommends 8 wt % for DMDHEU), will provide a durable press finish to the final payload-treated textile or web. Alternatively there may be two or more linker molecules that are employed to link the payload nanoparticle to the textile.

Where a controlled release of the payload on or into the textile is desired, the payload agent is embedded or entrapped within the polymeric encapsulator of the nanoparticle in a manner such that it can be released from the nanoparticle in a prolonged or otherwise controllable fashion. The release profile is programmed via the chemistry of the polymer network of the nanoparticle. The nanoparticle can be formulated with an almost infinite degree of designed characteristics via key structural features, such as crosslinking density, hydrophilic-hydrophobic balance of the copolymer repeat units, and the stiffness/elasticity of the polymer network (determined by the glass transition temperature). In addition, erodible nanoparticles can be developed to encompass dual release mechanisms of diffusion and erosion.

Furthermore, the polymeric encapsulator may contain components that react or respond to environmental stimuli to cause increased/decreased content release. "Smart polymers" are polymers that can be induced to undergo a distinct thermodynamic transition by the adjustment of any of a number of environmental parameters (e.g., pH, temperature, ionic strength, co-solvent composition, pressure, electric field, etc.). For example, smart polymers based on the lower critical solution temperature (LCST) transition may drastically cut off release when exposed to hot water during laundering. When cooled back to room temperature, sustained release resumes. Smart polymers may be selected from, but are not limited to, N-isopropyl acrylamide and acrylamide; polyethylene glycol, di-acrylate and hydroxyethylmethacrylate; octyl/decyl acrylate; acrylated aromatic and urethane oligomers; vinylsilicones and silicone acrylate; polypropylene glycols, polyvinylmethyl ether; polyvinylethyl ether; polyvinyl alcohol; polyvinyl acetate; polyvinyl pyrrolidone; polyhydroxypropyl acrylate; ethylene, acrylate and methylmethacrylate; nonyl phenol; cellulose; methyl cellulose; hydroxyethyl cellulose; hydroxypropyl methyl cellulose; hydroxypropyl cellulose; ethyl hydroxyethyl cellulose; hydrophobically-modified cellulose; dextran; hydrophobically-modified dextran; agarose; low-gelling-temperature agarose; and copolymers thereof. If crosslinking is desired between the polymers, multifunctional compounds such as bis-acrylamide and ethoxylated trimethylol propane triacrylate and sulfonated styrene may be employed. In presently preferred embodiments, the smart polymers comprise polyacrylamides, substituted polyacrylamides, polyvinylmethyl ethers, and modified celluloses.

Where it is desirable for the payload to be visible (when it is a dye, a UV protector, or a metallic reflector, for example), the nanoparticle or the surface coating thereof will be constructed of optically transparent or translucent material, allowing light to come into contact with the payload and be reflected, refracted or absorbed.

The polymeric set can be chosen to give either hydrophobic or oleophilic nanoparticles, allowing a wider array of bioactive compounds or drugs to be comfortably entrapped within. Where the particles are hydrophilic, they are easily dispersible in a stable aqueous suspension or emulsion by surfactants, which can subsequently be washed away without affecting the performance of the payload agent within. The inherent thermodynamic compatibility of the agents and polymeric encapsulator material can increase the loading level per particle.

The textile-reactive payload nanoparticles of the invention are present in their final form as beads or particles having a diameter of from a few microns to a few nanometers, preferably from about 1 to about 1000 nm, more preferably from about 10 to about 500 nm. The size of the textile-reactive nanoparticles will primarily be chosen for the best penetration into the particular fiber to be treated.

Additionally, the particles can be engineered to have either a narrow or a broad size distribution, depending on the intended release profile of the active agent.

The textile-reactive nanoparticles of the present invention can be formed in several ways, with the exact procedure for bead or particle formation being determined by processing features. These features include, but are not limited to, the solubility of the payload agent and/or the monomers/oligomers/polymers of the polymeric set; light stability, heat stability, and mechanical stability of the polymeric set as well as of the nanoparticle; and the like. Additional considerations, such as the desired properties of the resulting textile-reactive nanoparticles and their fiber-specific binding properties, may also dictate the exact formulation procedure required. Generally, to form the textile-reactive payload nanoparticle, the target payload agent is dissolved or dispersed in a suitable medium and a polymeric set, including appropriate textile-reactive hooks or functional groups, is added. The monomers, oligomers, or polymers of the polymeric set are then subsequently polymerized, giving the textile-reactive payload nanoparticle. Alternatively, the payload (particularly when it is a particulate) can be directly exposed to the coating polymeric set, without solvation or emulsification. The exposed particles may then be subjected to the required conditions (e.g. heat, pH, light, vacuum and so forth) to "set" the polymer network or surface coating.

Water-in-oil emulsification, a technique known to those of skill in the art, is one effective embodiment of the process for the synthesis of fiber-reactive payload nanoparticles. In this technique, water-soluble monomers of the polymeric set and the water-soluble payload agent are dissolved or dispersed in an aqueous medium, to which is then added an organic solvent and an emulsifier. The aqueous phase forms a fine emulsion comprising microspheres of the payload agent and the polymeric set in the continuous organic phase. An oil-soluble polymer or other compound having textile-reactive functional groups and monomer-reactive functional groups (the oil-soluble component of the polymeric set) is added to the emulsion. The oil-soluble compound crosslinks the polymeric set and forms a polymer shell (the polymeric encapsulator) around the aqueous microspheres, thus encapsulating the payload agent. The resultant nanoparticle has textile-reactive functional groups on its surface capable of attachment to the fibers of a textile or web. In this method, a presently preferred oil-soluble polymer is poly(maleic anhydride) or poly(styrene-co-maleic anhydride).

Where a particular payload agent is water-insoluble (such as indigo dye, for example), it may be converted to a water-soluble form (to leuco indigo, in the case of indigo) prior to reaction with the monomers, oligomers, or polymers and the oil-soluble compound following the above method. After the nanoparticle formation is completed, the payload is converted back to its water-insoluble form within the nanoparticle (by oxidation of leuco indigo, in the case of indigo).

Oil-in-water emulsification, a technique known to those of skill in the art, is another effective embodiment of the process for the synthesis of fiber-reactive payload nanoparticles. In this embodiment, a water-insoluble payload agent is dissolved in an organic solution with a polymer that includes an excess of textile-reactive functional groups. The organic solution containing the payload agent is added to an aqueous medium containing an emulsifier and a polymeric set that is reactive with the first, oil-soluble polymer, thus permitting some of the functional groups of the polymeric set to crosslink with the oil-soluble polymer to form a polymer shell (the polymeric encapsulator) around particles of the agent. The resulting textile-reactive payload nanoparticle encapsulates the payload agent and has uncrosslinked textile-reactive functional groups on its polymer surface capable of attachment to the fibers of a textile or web to be treated. In this method, a presently preferred oil-soluble polymer is styrene-maleic anhydride copolymer.

In a third embodiment of a method according to the invention, polymer nanoparticles having textile-reactive functional groups on their surfaces are prepared, following procedures known in the art. These nanoparticles are then placed into a solvent that causes them to swell, opening pores or passages in the wall of the nanoparticle. A payload agent placed in this mixture will diffuse into the swollen nanoparticles. The payload-agent-infused swollen nanoparticles are then treated with a second solvent that collapses their walls, thus providing textile-reactive nanoparticles with an entrapped payload agent.

The polymeric nanoparticles of the invention may also be prepared by atomization. A solution of the bead-forming polymer is formed from a polymeric set with a suitable solvent, and the payload is added to the solvated polymer. If the payload is a solid, it may either be solubilized in the solvent or, if it is insoluble in the solvent, it should be of a sufficiently small size and well dispersed in the polymeric solution. The polymer solution is then atomized into a drying gas atmosphere where solvent removal proceeds by simple evaporative drying. Such atomization techniques include high-pressure atomization, two-fluid atomization, rotary atomization, and ultrasonic atomization. The type of technique used, as well as the operating parameters, will depend on the desired particle or bead size distribution and the composition of the solution being sprayed. Such techniques are well taught in the literature, and ample description can be found in many texts, such as *Spray Drying Handbook* by K. Masters, herein incorporated by reference.

Droplet formation may also be accomplished by introducing the polymer solvent solution (containing the polymeric set and payload agent) into a second, immiscible liquid in which the polymer and payload agent are immiscible and the polymer solvent is only slightly soluble. With agitation, the polymer solution will form a suspension of spherical, finely dispersed polymer solution droplets distributed within the second liquid. The second liquid shall be chosen such that it is not a solvent for the polymer, and is somewhat incompatible with the polymer solvent such that the overall polymer solution is dispersible as discrete droplets with the second liquid. The second liquid must, however, provide a reasonable solubility for the polymer solvent such that the polymer solvent is extracted from the microdroplets in a manner analogous to evaporative drying. That is, as the microdroplets make contact with and disperse in the second, immiscible liquid, the polymer solvent is extracted from the droplets. Once sufficient solvent has been removed, the polymer will phase separate and form a polymer shell at the droplet surface, as in the case of evaporative drying. Further extraction of the solvent through the polymer shell wall results in nanoparticles composed of a polymer shell wall (the polymeric encapsulator) surrounding the payload agent.

In another embodiment of a method according to the invention, nano- or micrometer-sized particles are formed by milling of the bulk material. The materials are chosen so as to contain some surface functionality, most commonly hydroxyl groups. These particles are then treated with a polymer set chosen so as to amplify or modify the surface functionality, thus providing surface-coated nanoparticles that have amplified reactivity or have a greater variety of reactivity. In preferred embodiments, particularly with larger particle sizes, the surface coating (the polymeric encapsulator) will be further treated with long linker molecules, which will improve the reactivity of the particles with textiles and may assist in emulsifying the nanoparticles. Common non-limiting examples of the particle composition are metal and metal oxides such as silica, mica, glass, titanium dioxide, antimony oxides and ferrous and ferric oxides. The polymer set is preferably composed of functionalized alkoxy- and halo-silanes, which can be applied to the metal oxide surface by methods known to those skilled in the art. The polymer set may also be composed of a charged, textile-reactive polymer that electrostatically adheres to the particle and covalently binds to fibers. A preferred example is poly(ethylenimine) that has been grafted with an epoxide such as glycidol; this polymeric set adheres to metal oxides and can be attached to hydroxyl-containing fibers with the use of N-methylol compounds such as DMDHEU.

In forming the textile-reactive nanoparticles of the invention, additional crosslinkers or complementary reactive functionalities may also be added to the solution to bridge crosslinkable groups and to alter the crosslink density. Polymerization can be accomplished by reaction methods known in the art. The crosslinking of the monomers, oligomers, or polymers and the textile-reactive functional groups is commonly produced by heat or by radiation, such as UV light or gamma rays. Catalysts or photo- or thermal-initiators can be used to promote crosslinking. Such initiators and catalysts are well known in the art and are commercially available.

In preparing the textile-reactive nanoparticles of the invention, the process temperature can vary widely, depending on the reactivity of the reactants. However, the temperature should not be so high as to decompose the reactants or so low as to cause inhibition of the reaction or freezing of the solvent. Unless specified to the contrary, the processes described herein take place at atmospheric pressure over a temperature range from about 5° C. to about 150° C., more preferably from about 10° C. to about 100° C., and most preferably at "room" or "ambient" temperature ("RT"), e.g. about 20° C. The time required for the processes herein will depend to a large extent on the temperature being used and the relative reactivities of the starting materials. Following formation, the textile-reactive payload nanoparticles can be isolated by filtration, by gravity/settling/floating, by centrifugation, by evaporation, or by other known techniques. Any residual oil can be removed, if desired, by extraction with an appropriate solvent, by distillation at reduced pressure, or by other known techniques. Unless otherwise specified, the process times and conditions are intended to be approximate. Those skilled in the art of polymerization reaction engineering and materials handling engineering can readily devise the appropriate processes for the intended applications.

This invention is further directed to the fibers, yarns, fabrics, textiles, or finished goods (encompassed herein under the terms "textiles" and "webs") treated with the textile-reactive nanoparticles. Such textiles or webs exhibit a greatly improved retention of the payload and its activity. By "greatly improved" is meant that the payload encapsulated in a textile-reactive nanoparticle will remain on the web and its activity will be retained to a greater degree than the payload alone, even after multiple washings. For example, where the payload is a dye, the treated textiles or webs exhibit a greatly improved colorfastness and resistance to fading. When the payload is a reflective material, the textile exhibits a durable reflective or pearlescent sheen or shininess, dependent upon the size of the nanoparticle. Textiles or webs treated with nanoparticles containing a sunblock agent as the payload will absorb, block, reflect or otherwise prevent or substantially prevent harmful UV radiation from passing through the textile and also will not harm the textile itself. When the payload is an anti-microbial/fungal agent, a drug, a pharmaceutical or an enzyme, the bioactive agents are depleted only by programmed release from the nanoparticles and not from unintended detachment or release of the particles themselves from the web. This is due to the durability of the chemical bonds between the fibers and the functional groups of the nanoparticles.

The novel webs of the present invention include fibers and/or filaments; woven, knitted, stitch-bonded, and non-woven fabrics derived from natural, man made, and/or synthetic fibers and blends of such fibers; cellulose-based papers; and the like. They can comprise fibers in the form of continuous or discontinuous monofilaments, multifilaments, fibrids, fibrillated tapes or films, staple fibers, and yarns containing such filaments and/or fibers, and the like, which fibers can be of any desired composition. The fibers can be of natural, man-made, or synthetic origin. Mixtures of natural fibers, man-made fibers, and synthetic fibers can also be used. Included with the fibers can be non-fibrous elements, such as particulate fillers, flock, binders, sizes and the like. The textiles and webs of the invention are intended to include fabrics and textiles, and may be a sheet-like structure [woven (including jacquard woven for home furnishings fabrics) or non-woven, knitted (including weft inserted warp knits), tufted, or stitch bonded] and may be comprised of any of a variety of fibers or structural elements. The nonwovens may be stitch bonded, ultrasonic bonded, wet laid, dry laid, solvent extruded, air or gas blown, jet interlaced, hydroentangled, and the like, and may have a broad variety of properties including stretch, air permeability, or water vapor breathability. Examples of natural fibers include cotton, wool, silk, jute, linen, and the like. Examples of manmade fibers derived primarily from natural sources include regenerated cellulose rayon, Tencel® and Lyocell, cellulose esters such as cellulose acetate, cellulose triacetate, and regenerated proteins. Examples of synthetic fibers or structural elements include: polyesters (including polyethyleneglycol terephthalate), wholly synthetic polyesters, polyesters derived from natural or biological materials such as corn, polyamides (e.g. nylon), acrylics, olefins such as polyethylene or polypropylene, aramids, azlons, modacrylics, novoloids, nytrils, aramids, spandex, vinyl polymers and copolymers, vinal, vinyon, and hybrids of such fibers and polymers.

To prepare webs having a permanently attached payload, the fiber, the yarn, the fabric, or the finished good is exposed to a solution or dispersion/emulsion of the textile-reactive payload nanoparticles, by methods known in the art such as soaking, spraying, dipping, fluid-flow, padding, and the like. If needed for the attachment reaction, a catalyst is also present in the solvent or emulsion. The textile-reactive functional groups on the nanoparticles react with the textile or web, by covalent bonding, to permanently attach to the textile. This curing can take place either before or after the treated textile is removed from the solution and dried, although it is generally preferred that the cure occur after the drying step.

Alternatively, textile-reactive payload nanoparticles are suspended in an aqueous solution that contains a linker molecule (e.g. a compound having two or more N-methylol groups, such as DMDHEU or DMUG). A catalyst may also be included (e.g. for N-methylol linkers, a Lewis acid catalyst, such as $MgCl_2$). A surfactant may be used to help suspend the particles. The fiber, the yarn, the fabric, the nonwoven web, or the finished good to be treated is then exposed to the solution containing the textile-reactive payload nanoparticles and the linker compounds, by methods known in the art (such as by soaking, spraying, dipping, fluid-flow, padding) and dried. The linkers react with the web, by covalent bonding, and the functional groups on the payload-laden nanoparticles react with the linker compounds to permanently attach the particles to the web. The binding reactions may occur before, during or after the drying process.

The concentration of the textile-reactive payload nanoparticles in solution can be from about 0.1% to about 95%, preferably from about 0.4% to about 75%, more preferably from about 0.6% to about 50%; depending, however, on the rheological characteristics of the particular polymer nanoparticle selected (such as size or material) and on the amount of payload-deposition or -activity desired.

In preparing the treated textiles and webs of the invention, the process temperature can vary widely, depending on the affinity of the textile-reactive functional groups for the substrate. However, the temperature should not be so high as to decompose the reactants or damage the web, or so low as to cause inhibition of the reaction or freezing of the solvent. Unless specified to the contrary, the processes described herein take place at atmospheric pressure over a temperature range from about 5° C. to about 180° C., more preferably from about 10° C. to about 100° C., and most preferably at "room" or "ambient" temperature ("RT"), e.g. about 20° C. The temperature may vary between the application step, the drying step, and the curing step. Most commonly, application of the textile-reactive payload nanoparticles will occur at RT, whereas drying and curing will occur at higher temperatures. The time required for the processes herein will depend to a large extent on the temperature being used and the relative reactivities of the starting materials. Therefore, the time of exposure of the web to the polymer in solution can vary greatly, for example from about one second to about two days. Normally, the exposure time will be from about 1 to 30 seconds. Following exposure, the treated web is dried at ambient temperature or at a temperature above ambient, up to about 90° C. The pH of the solution will be dependent on the web being treated. For example, the pH should be kept at neutral to basic when treating cotton, because cotton will degrade in acid. Additionally, the deposition of payload nanoparticles with charged groups (e.g., amines, carboxylates, and the like) is expected to be dependent on solution pH. Salts (e.g. sodium chloride) may optionally be added to increase the rate of adsorption of anionic and cationic payload nanoparticles onto the web fibers. Unless otherwise specified, the process times and conditions are intended to be approximate.

In order to further illustrate the present invention and advantages thereof, the following examples are given, it being understood that the same are intended only as illustrative and are not in any way limiting.

EXAMPLES

I. Textile-Reactive Anti-Microbial and/or Anti-Fungal Nanoparticles

Fabric treatments endowed with anti-microbial or -fungal properties are highly desired by the apparel, home furnishings, and medical industries. Natural fibers (and most other fibers under normal use conditions) cannot last indefinitely, and most are subject to attack by microorganisms. When knitted or woven into fabric and used as apparel or home furnishings materials, the fibers are in contact with human skin. Microbial and fungal contamination is a significant problem in medical settings. Certain fabric products are required for hospital or other sterile applications where decontamination is of utmost importance. Sheets, towels, undergarments, socks, hosiery, active wear, home and institutional furnishings (including carpets), and uniforms possessing anti-microbial and anti-fungal properties are also valuable.

In one embodiment of the invention, the nanoparticle encloses an anti-microbial/fungal agent as the payload. The resulting encapsulated anti-microbial/fungal agent preparations or nanoparticles have improved retention within and on the textile or web fiber structure. Because the anti-microbial/fungal compounds themselves are not chemically modified, the activity of the bioactive agent is unchanged. The term "anti-microbial/fungal agent" as used herein and in the appended claims refers to agents or drugs having bioactivity, such as anti-microbial or anti-fungal activity. An example is 3-(trimethoxysilyl)-propyloctadecyldimethyl ammonium chloride, known as Sylgard®. A plethora of active agents have been identified, including silver nitrate, colloidal silver, 6-acetoxy-2,4-dimethyl-m-dioxane, 2-bromo-2-nitropropane-1,3-diol, 4,4-dimethyloxazolidine, hexahydro-1,3,5-tris(2-hydroxyethyl)-s-triazine, zinc dimethyldithiocarbamate, zinc 2-mercaptobenzothiazole, zinc 2-pyridinethiol-1-oxide, N-trichloromethylthio-4-cyclohexene-1,2-dicarboximide (*Sanford's Guide to Antimicrobial Therapy*, Medical Book System, 1997).

The textile-reactive anti-microbial/fungal nanoparticle of the invention is designed so that the bioactive agent is embedded or entrapped within the polymeric encapsulator, while at the same time being able to be released from the nanoparticle in a prolonged or controlled fashion. The release profile is programmed via the chemistry of the polymer network of the nanoparticle. The nanoparticle can be formulated with an almost infinite degree of designed characteristics via key structural features, such as crosslinking density, hydrophilic-hydrophobic balance of the copolymer repeat units, and the stiffness/elasticity of the polymer network. Erodible nanoparticles can be developed to encompass dual release mechanisms of diffusion and erosion. Because of the durability of the chemical bonds between the fibers and the functional groups of the nanoparticles, the bioactive agents are depleted only by programmed release from the particles and not from unintended detachment or release of the particles themselves from the web. In addition, the polymeric encapsulator may be designed to respond either positively or negatively to certain environmental stimuli, thus triggering or shutting off payload release.

II. Textile-Reactive Dye Nanoparticles

To retain the original shade of a garment through laundering, dye retention is critical. Covalent binding of the dye molecule itself to the fabric fibers can alleviate fading. However, chemically reactive dyes tend to be expensive due to additional synthesis costs. Moreover, chemical modification of many unreactive dyes to make them reactive also results in an undesired color change. The term "unreactive dye" as used herein refers to a dye that does not normally react chemically, via covalent bonding, with a textile or web fiber. Such dyes are commonly found within the physical-adsorption and mechanical-retention dye groups.

Therefore, in another embodiment of the invention, the textile-reactive preparations of the invention comprise an unreactive dye as the payload surrounded by or contained within a polymer shell (the polymeric encapsulator) that is reactive to textiles or other webs, thus providing textile-reactive dye nanoparticles. The polymer shell of the nanoparticle has a surface that includes functional groups for binding or attachment to the fibers of the textiles or other webs to be treated. The resulting encapsulated dye preparations or nanoparticles have improved colorfastness and retention within and on the textile or web fiber structure, without changing the base color of the dye. In a presently preferred embodiment, the unreactive dye for use in the present invention is indigo.

The dye may be water-soluble or water-insoluble. Where the dye is insoluble, it may, in certain cases, optionally be converted to a water-soluble form prior to incorporation into the textile-reactive nanoparticle, for process manufacturing purposes. After polymerization of the polymeric shell, the dye is then converted back to its insoluble form within the bead. An example of such a dye is indigo, which is water-insoluble in its desired blue form but which can be reversibly reduced to its soluble form (leuco indigo, which is yellow in color).

The polymer shell of the textile-reactive dye nanoparticle will be thin enough that it will be transparent, allowing the color of the dye to show through.

The reactive hooks can be chosen from those hooks that bind durably with the textile or web fibers to be dyed, to give a durable deeply colored fabric, or from those hooks that are controllably degraded, to provide varying degrees of "faded" color (for example, "stone-washed" blue jeans). One method of controllably degrading the color provided by the dye nanoparticles is to choose textile-reactive functional groups that form bonds with the fibers that can be controllably hydrolyzed via standard chemical means. The degree of fading can be controlled by the number of hydrolyzable versus non-hydrolyzable textile-reactive functional groups present on the dye nanoparticle surfaces.

In a presently preferred embodiment of the invention, the dye is indigo and the web or textile is denim. Denim is a woven fabric formed by interlacing or intermeshing cotton yarns. The direction of weaving is called the "warp" direction, and the cross direction is called the "weft" or "filling" or "fill". The weft yarns alternately go over and under the warp yarns; for example, in a plain weave or a two-by-one (2×1) twill weave construction. The warp yarn in denim has been dyed, prior to weaving, with indigo, a naturally occurring blue dye. Indigo dyeing can be performed to various depths of shade ranging from light blue to very dark blue or even black. The pattern produced by weaving indigo-dyed warp yarn with white fill yarn results in the typical denim look.

Because indigo in its oxidized (blue) form is water-insoluble, the current methods for dyeing warp yarns for processing into denim fabric are cumbersome, time-consuming, and produce excessive amounts of waste material. Additionally, for the "stonewashed" denim appearance, a complicated process of enzyme digestion and/or stone-washing (optionally using bleaching agents) is currently required, which weakens both the warp and the fill yarns. Because indigo is an "unreactive" dye, fading of the denim occurs quickly. While in the past this has been fashionably desirable, current fashion trends call for a dark blue, non-fading denim material.

The present invention provides distinct advantages over the current process for the manufacture of denim. There is no need to perform a redox reaction on indigo during the dyeing process, with a resulting wastewater slurry to dispose of. The present method is a facile, one-dip process. The textile-reactive indigo nanoparticles bind strongly with the cotton fibers to provide a dark blue fabric that does not fade. For fabric with a stonewashed appearance, fading can be achieved by a lighter dyeing without enzyme digestion. In addition, the rate of fading can be controlled by the number of degradable textile-reactive functional groups present on the indigo dye nanoparticles, the rate of hydrolysis of the degradable nanoparticles, and/or the size of the nanoparticles. Alternatively, the nanoparticle-dyed garment may be stonewashed prior to curing (chemical fixation) to achieve the desired faded look. Upon achieving the desired faded appearance, the reactive hooks on the nanoparticles are allowed to react with the cotton, thus durably setting the appearance.

While the example discussed above has been directed to indigo dye and denim fabrics, the advantages of the textile-reactive nanoparticles of the present invention can be extended to other dyes and to other webs, and such are within the spirit and scope of the invention.

Example II-1

Preparation of Textile-Reactive Indigo Nanoparticles via Interfacial Polymerization Interfacial polymerization was used to generate blue spherical particles containing indigo, using a water-in-oil polymerization under the following conditions. Reduced indigo (leuco indigo) (0.016 g) and poly(ethylenimine)(PEI; mol wt. 2000; 0.23 g) were dissolved in a small amount of water and added to toluene (125 mL). The water phase formed a microemulsion in the toluene oil phase, using AOT (10 g) as the surfactant. An oil-soluble poly(styrene-co-maleic anhydride) (mol. wt. 1900; 0.89 g) was then added to the emulsion, and some of the maleic anhydride groups crosslinked with the amines of the PEI to form a polymer shell around the aqueous spheres, encapsulating the leuco indigo. Excess maleic anhydride groups were present on the polymer shell surface to serve as hooks for attachment of the encapsulated dye to cotton. When the reaction mixture, initially under nitrogen, was exposed to air, the leuco indigo inside the nanoparticles oxidized to indigo and the nanoparticles turned blue.

The polymer microspheres produced were 1–5 $\mu$m in diameter, high in indigo loading (dark blue), and stable to an aqueous work-up. Increasing the surfactant concentration reduces the particle size somewhat and improves their monodispersity. By increasing the indigo loading, the color of the particles (bead) was significantly darkened.

Example II-2

Preparation of Textile-Reactive Indigo Nanoparticles via Precipitation Polymerization Polymerization around precipitated indigo has been performed under the following conditions. Indigo (1.60 g) was dissolved in DMSO (20 mL) and styrene-maleic anhydride copolymer (SMA; 2.20 g). This mixture was then added to water (100 mL) containing polyethylenimine (PEI; 0.20 g), and heated to 55° C. for 1 hr. Without being bound by theory, it is believed that upon precipitation, the SMA surrounded the indigo particles and then crosslinked with PEI to form a shell. The shell was formulated to contain excess maleic anhydride groups, which are then available to bind to cotton. These particles were 2–5 microns in diameter, with an irregular shape.

Example II-3

Colorfast Indigo-Dyed Cotton

Washfastness of cotton dyed with textile-reactive nanoparticles of the present invention was compared to that of traditional leuco indigo-dyed cotton. A swatch of bleached cotton was dipped into a dye solution (either reduced indigo (leuco indigo), or indigo nanoparticles from Example II-2 above, or indigo nanoparticles from Example II-2 together with 4 wt % sodium hypophosphite catalyst) for one minute. The swatch was removed from the dye solution, blotted dry with Kimwipe® towels, and then placed in an 80° C. oven for 30 minutes. These steps were repeated two more times. For the cotton swatches dyed with the solution containing the catalyst, there was an additional, final step of curing the swatch in a 200° C. oven for 2 minutes.

The dyed swatches were then laundered to determine wash fastness, as follows. Tide® detergent (1.0 g) was added to tap water (1000 mL), and the detergent mixture was heated, with stirring, to 60° C. The dyed cotton sample was then placed in the mixture and stirred for 20 minutes, after which it was removed, rinsed in tap water, and blotted dry with a Kimwipe, after which it was dried in an 80° C. oven for 30 minutes. All of the above washing/drying steps were repeated for a total of ten times.

The results showed that the cotton dyed with leuco indigo exhibited the lightening/fading typical of blue jeans and other indigo-dyed cotton after ten launderings. The cotton dyed with indigo nanoparticles of the present invention with cotton-reactive hooks showed very good wash fastness after ten launderings. The cotton dyed with indigo nanoparticles without cotton-reactive hooks exhibited low wash colorfastness after ten launderings. As expected, the incorporation and activation of cotton-reactive hooks on the indigo nanoparticles greatly increases wash fastness.

III. UV-Protective Textile-Reactive Nanoparticles

The harmful effects of solar radiation are well known. Ultraviolet (UV) light can cause sunburn, skin aging, premature wrinkling, and cancer. In addition, UV light fades and weakens garments and other textiles and webs.

Thus, in yet another embodiment, the textile-reactive preparations of the invention comprise a particulate sunblock agent as the payload, surrounded by or contained within a polymeric encapsulator that is reactive to textiles and other webs, thus providing textile-reactive UV-protective Nanoparticles. The polymeric encapsulator of the nanoparticle includes functional groups that can bind to the fibers of the textile or web. Alternatively, the surface includes functional groups that can bind to a linker molecule that will in turn bind or attach the bead to the fiber. The resulting encapsulated UV-blocking preparations or nanoparticles have improved retention within and/or on the textile or other web fiber structure.

The term "particulate sunblock agent" as used herein refers to the solid physical sunblocks such as titanium dioxide ($TiO_2$), zinc oxide (ZnO), silica ($SiO_2$), iron oxide ($FeO_2$ or $Fe_2O_3$), and the like. These provide a sunscreening or protective benefit by reflecting, scattering, or absorbing harmful UV or visible radiation. In a presently preferred embodiment, the particulate sunblock agent is selected from $TiO_2$ and ZnO. Dispersed particles of $TiO_2$<30 nm are completely transparent in the visible range but will block UV light. Dispersions of larger $TiO_2$ particles (30–35 nm) are cloudy because of the distribution of particle sizes in commercial production. Even larger particles produce a white color. The titanium dioxide may optionally have a protective inorganic coating on the particles, composed of silica, alumina, or zirconia, a mixture of these coatings, or other inorganic coatings. Such compositions are known in the art. These coatings prevent the production of titanium oxide free radicals on the surface of the $TiO_2$ particle upon sun exposure, and thus prevent damage to the polymeric encapsulator of the nanoparticle of the invention. Thus, when the barrier textile is to be exposed to significant amounts of light, the titanium dioxide used in the textile-reactive UV-protective material will preferably be coated with an inorganic layer prior to its incorporation into the nanoparticle.

The particulate sunblock agent may be coated with silane coupling agents or it may be encapsulated with polymers to provide an organic layer surrounding the particulate. The layer may be covalently or electrostatically attached to the sunblock agent particle, or it may be crosslinked to form a polymeric shell around the particle. The monomers or polymers of the organic coating layer contain functional groups that react with a web fiber surface.

Silane coupling agents having the general formula $R_1SiX_3$, $R_1R_2SiX_2$, or $R_1R_2R_3SiX$ may be used to form the polymeric or monomeric surface coating. $R_1$, $R_2$, and $R_3$ are carbon-containing radicals that include functional groups that can bind to a fabric surface. X is a hydrolyzable group that includes, but is not limited to, Cl, Br, I, —$OCH_3$ (methoxy), —$OCH_2CH_3$ (ethoxy), —OR' (alkoxy, where R' is any alkyl group), —$OC(O)CH_3$ (acetoxy), $CH_3C{=}CH_2O$— (enoxy), $(C_2H_5)(CH_3)C{=}NO$— (oxime), and $(CH_3)_2N$— (amine). These reagents bind directly to silica and some other inorganic surfaces, such as the inorganic coating on silica-coated $TiO_2$ particles, and they also crosslink with each other to produce durable surface coatings. In the case of $R_1R_2R_3SiX$, one only obtains a covalent bond directly to the surface by reaction with a surface hydroxyl group; i.e., $R_1R_2R_3SiX$ and a HO-M-group (M=metal) react to form a $R_1R_2R_3Si$-O-Si-particle and no further crosslinking to other silane molecules is possible. In the case of $R_1SiX_3$ and $R_1R_2SiX_2$, bonds to the surface of the particle and to other identical silane molecules create a polymeric network or surface coating. The presently preferred embodiment is $R_1SiX_3$ (because its maximized ability to crosslink provides the greatest stability to a coating), followed by $R_1R_2SiX_2$ and finally $R_1R_2R_3SiX$. There may also be applications where it is advantageous to include different silanes having different numbers of R and X groups, or silanes that have different R groups but the same number of X groups. Furthermore, silane-coupling agents can form durable, crosslinked polymeric coatings around a particle, without covalently binding to a surface. In the case of silica-coated $TiO_2$, covalent bonds are expected. However, in the case of ZnO, covalent bonds to the surface do not form, but a durable crosslinked coating is still attainable.

The organic polymeric encapsulator will be thin enough to be transparent, allowing UV light to come into contact with and be reflected, refracted, or absorbed by the sunblock agent particles. The nanoparticle shell will preferably be a monolayer.

The size of the sunblock agent particles in the sunscreening nanoparticles can be small, ranging from 10 nm to about 150 nm, particularly when it is desirable for the nanoparticles to be transparent, such as when one wishes the color of the web to show through. Alternatively, 100–1000 nm particles provide an opaque white color. Because the sunblock agent particles are protected within the polymer nanoparticle and the nanoparticle is permanently attached to the textile, the resultant color of the textile will not yellow with age or after multiple washings.

If a silane coupling agent is applied to the surface of a particulate sunblock agent, one of a number of methods that are described in the literature may be used. These include refluxing a mixture of a silane in an organic solvent with the particulate sunblock agent. An additional method that may be used is to deposit the silane from a solution of an alcohol, or a solution of water, or a solution of an alcohol and water. Bulk deposition by spray-on of a solution of the silane in alcohol onto sunblock agent particles in a high intensity solid mixer may also be utilized. Silanes that are commercially available and that contain the necessary functional groups to both bind to an inorganic surface, crosslink to itself, and bind to fabrics include 3-(triethoxysilyl) propylsuccinic anhydride (possibly employing a catalyst that is capable of reforming any opened anhydride groups) and N-(3-triethoxysilylpropyl)gluconamide (using a compound that contains two or more N-methylol groups).

In an alternative approach to silane coatings, it has been shown that poly(ethylenimine) (PEI) has a high affinity for silica and other hydroxyl-terminated surfaces, and addition of the particulate material to an aqueous solution of PEI results in polymeric encapsulation of the particles. To optimize the surface coverage of PEI, excess PEI may be added to the solution, and unadsorbed PEI may be removed later by washing the particles after adsorption has taken place. Alternatively, a calculated amount of PEI, sufficient to cover the particle, may be mixed with the particle, followed by a crosslinking agent such as a diepoxide or an epoxide-containing polymer. The epoxides will react with amine groups in the PEI, binding together PEI chains, encapsulating the particles, and will also form hydroxyl groups that can be attached to fibers of a cellulose-based web with N-methylol resins such as DMDHEU.

Example III-1

Preparation of Silane-Coated Titanium Dioxide Nanoparticles 0.50 Grams of silica-coated $TiO_2$ particles were added to 30 mL of isooctane and 3 mL of 3-(triethoxysilyl) propylsuccinic anhydride. The mixture was stirred and refluxed under nitrogen overnight. It was then rinsed 3 times with isooctane (the particles settled out after each rinse and the liquid was decanted) and then rinsed with acetone and centrifuged 3 times. The particles were finally rinsed with water and centrifuged. After drying the particles in the oven, infrared spectroscopy showed the peaks expected for the silane coating.

Example III-2

Preparation of Textile-Reactive Zinc Oxide Nanoparticles 42.5 Grams of ZnO (James M. Brown Ltd., FPS grade, 7–9 $m^2/g$ surface area) was rinsed in ethanol. The ethanol/ZnO mixture was then centrifuged to separate out the particles, the ethanol was decanted, and the particles were allowed to dry in the air. The washed particles were then added to a solution of 2% 3-aminopropyltrimethoxysilane in 95% water/5% ethanol (2.2 g aminosilane), and the mixture was stirred for 5 minutes. The solution was centrifuged, the liquid was decanted, and the remaining particles were cured at 115° C. for 15 minutes. The particles were finally rinsed once in ethanol and twice in methylethylketone (MEK). After the solvent was added each time, the particles were suspended, the mixture was centrifuged, and the solvent was decanted. After the final rinse, the coated particles were added to 150 mL MEK, followed by 4.8 g styrene-maleic acid (MW~1900), which was first dissolved in a minimal amount of acetone. The mixture was shaken for 1 hr, centrifuged, and the resulting particles were rinsed twice with acetone. The silane-coated ZnO particles were finally dried at 80° C. for 5 minutes.

Example III-3

Application of Silane-Coated ZnO Particles to Cotton Fabric

4 Grams of coated ZnO particles or beads, prepared in Example III-2, were added to 15 g of 5% $NaH_2PO_2$ in water. A piece of cotton fabric was added to the mixture, and the fabric and mixture were shaken together vigorously for a few minutes, after which the cotton was removed and dried/cured at 160° C. for 15 min. The sample was then rinsed for 3 min. under flowing tap water and then briefly rinsed in distilled water. It was finally dried at 82° C. in the oven.

Examples III-4–7

Preparation of Various Silane-Coated Textile-Reactive Nanoparticles

The procedure of Example III-2 was used to coat 20 nm $TiO_2$ particles (Example III-4), 1 $\mu$m ZnO particles (Example III-5), 59–76 nm (radius) ZnO particles (Example III-6), and 89–134 nm (radius) ZnO particles (Example III-7).

Example III-8

Examination of UV-Blocking Activity

The UV blocking power of the particles of Examples III-4–7 was examined. Cotton was treated, in duplicate, with the particles of Examples 4–7, following the procedure of Example III-3. Also measured were control samples of cotton that were completely untreated as well as cotton that was treated with the catalyst, baked, and then rinsed exactly as those that had $TiO_2$ or ZnO in them. The following Table 1 gives %UVA transmittance (UVA: 315–400 nm), %UVB transmittance (UVB: 280–315 nm), and the UPF (the ultraviolet protection factor) measured for all of the samples. The UPF is given according to the Australian/New Zealand Classification System (AU/NZS 4399:1966):

15–24 Good Protection
25–39 Very Good Protection
40–50 Excellent Protection
The highest possible UPF value is 50.

TABLE 1

| sample | % UVA transmittance | % UVB transmittance | UPF |
|---|---|---|---|
| Untreated. | 34.41 | 24.51 | 1 |
| Untreated. | 32.44 | 24.96 | 1 |
| Treated with catalyst. | 30.54 | 21.82 | 1 |
| Treated with catalyst. | 26.53 | 16.65 | 5 |
| $TiO_2$ (20 nm). | 21.26 | 13.37 | 5 |
| $TiO_2$ (20 nm). | 14.86 | 8.61 | 5 |
| ZnO (1 $\mu$m). | 12.73 | 7.29 | 10 |
| ZnO (1 $\mu$m). | 9.88 | 5.33 | 15 |
| ZnO (59–76 nm). | 4.11 | 2.16 | 40 |
| ZnO (59–76 nm). | 4.12 | 1.93 | 45 |
| ZnO (89–134 nm). | 3.50 | 1.74 | 45 |
| ZnO (89–134 nm). | 2.96 | 1.55 | 50 |

IV. Fragrances/Scents

Controlled, lasting release of fragrance is a desirable property for an article of clothing. Thus, in a further embodiment of the invention, a textile-reactive nanoparticle encloses a fragrance or a scent as the payload. The nanoparticle can be designed to release the fragrance at a constant or prolonged rate, or to "intelligently" release the fragrance in response to a particular environmental trigger such as temperature or light.

Example IV-1

3 g of bisphenol A are dissolved in 10 g of a solvent mixture of acetone and methylene chloride (1:3 by weight). The resulting solution is added to 30 g of citronellol (an oily fragrance with a fresh, rich, rose-like scent) as the core material to form a primary solution. Thereafter, 4 g of tolylene diisocyanate and 0.05 g of dibutyltin laurate as a catalyst are added to the solution to form a secondary solution. These solutions are prepared at temperatures lower than 25° C.

The secondary solution prepared above is slowly added with vigorous stirring to a solution of 5 g of acacia (gum arabic) in 20 g of water, whereby an oil drop-in-water-type emulsion having oil drops of 5–10 microns in average size is formed. In this case, the above procedure is conducted while cooling the vessel so that the temperature of the system is not increased over 20° C. If the temperature of the system during the emulsification is higher than the boiling point of methylene chloride, i.e. 40° C., capsulation would begin to give capsules having uneven sizes.

When emulsification is finished, 100 g of water at 40° C. is added to the emulsion with stirring. Thereafter, the temperature of the system is gradually increased to 90° C. over a period of 30 minutes. The system is maintained at 90° C. for 20 minutes with stirring to complete the capsulation. Microcapsules containing citronellol with a carbohydrate shell (acacia) are formed.

The microcapsules are attached to cotton fabric using well-known methylol chemistry to link the carbohydrate shell of the microcapsule to the cotton. DMDHEU is added to the solution to 8% by weight, followed by addition of $MgCl_2$ to 2% by weight of solution. 10-oz. cotton cloth is padded with this solution to 70% wet pickup and cured at 165° C. for 2 minutes to covalently link the fragrance-laden nanoparticles to the fabric.

V. Colloidal Pigments/Reflectors

Muscovite Mica is a naturally occurring silicate that is approximately 46% silica, 33% alumina, 10% potassium oxide, with other oxides making up the balance including iron, sodium, titanium, calcium, and magnesium oxides. Mica cleaves naturally into platelet-shaped particles that are reflective. These particles are used in cosmetics to impart a luster that is dependent on particle size. Smaller particles lead to a silk-like luster, while larger particles give a more glittery effect.

As with the titanium dioxide particles from Example III, there are two main strategies for the durable attachment of mica particles to textiles: functionalization of the mica particles with an organosilane or coating the mica particles with a polymer shell. Experimental examples of both approaches follow. The addition of chemicals to increase the viscosity of the final solution assists with the even application of mica across the fabric.

Example V-1

Functionalization of the Mica Particles with an Organosilane:

2.1 g oven-dried 800 mesh mica (silver white) was placed in a round bottom flask and 0.08 g (4 wt %) water was added. The round bottom was attached to a rotary evaporator without the condenser or vacuum turned on to spin for 3 hours. 10 g of 3-aminopropyltriethoxysilane was dissolved in 6.5 g of toluene that had been dried over molecular sieves. The toluene solution was added to the hydrated mica and spun for 2 hrs before being heated to between 100° C. and 125° C. for 1.5 hours. During the heating the vacuum was turned on periodically, but not for more than 30 min. total. The functionalized mica was then cooled, filtered, and washed with toluene, methanol, water, and methanol, then air-dried and oven-dried. This resulted in amine-terminated mica.

0.1 g of amine-terminated mica, 0.5 g of glycidol and 44.4 g of water was stirred together for 1 hour. After the addition of 5 g of PatCoRez P-53 (a DMDHEU resin/catalyst mixture) and the adjustment of the solution's pH to 4.5 with hydrochloric acid, the solution was padded onto a 6"×6" swatch of denim and cured at 350° F. for 3 min. Other organosilanes will yield other functional groups to use in attaching the mica to the textile. For example, an epoxy-terminated mica could be used to bond the mica to PEI. This amino-terminated mica can also be coated in polymer by reacting with epoxy-functionalized polybutadiene.

Example V-2

Coating Mica Particles with a Polymer Shell

A 10 g portion of 50% polyethylenimine ($M_n$=10,000) solution (aq) was stirred with 0.6 g glycidol and 6.4 g of water for 30 minutes. A 0.2 g portion of 800 mesh mica (silver white) was added to the PEI solution and the resulting slurry was stirred for another 30 min. 8.3 g of the PEI-mica solution made above was added to 5 g of PatCoRez P-53 and 36.7 g of water. This solution was adjusted to a pH of 4.5 and padded onto a 6"×6" swatch of black denim. The treated denim was cured at 350° F. for 3 min. Visibly significant numbers of the mica particles remained attached to the treated fabric through twenty standard home launderings. Fabric that was padded with mica and PatCoRez P-53 alone lost the mica particles after a single laundering.

VI. Zeolites

Zeolites are porous, inorganic materials composed primarily of silicates and aluminates. These metal oxides have hydroxyl surfaces similar to mica particles. Zeolites have found use in many areas, such as catalysis, molecular sieves, adhesion, and ion exchange. As an example of the last area, Healthshield (Wakefield, Mass.) has developed a zeolite that is impregnated with silver, an ancient and well-known antimicrobial agent that is efficacious even at very low levels. Healthshield has evidence showing that the silver ions in the zeolite slowly diffuse out of the zeolite, affording durable, longlasting antimicrobial activity against a number of bacteria and fungi. Zeolites can be produced in sizes that are appropriate to produce zeolite payload nanoparticles. For example, the size of the Healthshield zeolites are from 0.6 to 2.5 micrometers.

Silver-containing zeolite payload nanoparticles can be produced by exposing zeolite particles (from Healthshield) to an aqueous solution of poly(ethylenimine) (PEI) that has been grafted with an epoxide, following procedures disclosed hereinabove. Without being bound by theory, it is believed that the derivatized PEI forms a network of electrostatic bonds over the surface of the zeolite. The PEI is hydrophilic, so that silver ions can diffuse out of the zeolite payload nanoparticle that is formed in this manner. These nanoparticles can be permanently attached to fabrics with reactive groups (e.g. cellulose or proteinaceous textiles or webs) through the use of linker molecules. A presently preferred embodiment utilizes a resin such as DMDHEU as a linker, which reacts with the hydroxyl groups of the derivatized PEI as well as the hydroxyl groups of cellulose-based fibers. The zeolite payload nanoparticles are padded onto fabric together with the resin; the fabric is then dried and cured. Fabrics thus treated will show substantially less microbial growth on them in comparison to untreated fabrics. This antimicrobial property of the fabric will be durable to multiple launderings of the fabric, because the zeolite payload nanoparticles are chemically attached to the fibers.

Examples of Other Agents that May be Used as a Payload

VII. Metallic Particles for EMF Shielding/Conductivity/Antistatic Use

VIII. Thermotropic Liquid Crystals—change color based on body heat

IX. Magnetic Particles—used in hard disk magnetic data storage media

To make fabric that can be magnetized (in whole or selected spots). In the future, "patterned" magnetic/conductive regions will protect clothes from being shoplifted. There will be no need for attaching a bulky ink-filled or bulky cartridges that trigger alarm sensors at checkout counters. Also, SKU's (barcodes) can be better inventoried.

X. Insect Repellents

XI. UV-Absorber Dyes (not particles)

XII. Photochromic Dyes and Photoimagenable Dyes

Useful to create patterns by imaging, than by printing.

What is claimed is:

1. A textile-reactive nanoparticle comprising a payload entrapped within a polymeric encapsulator, wherein the polymeric encapsulator is transparent or translucent and comprises at least one textile-reactive functional group on its surface for attaching to a textile fiber.

2. A nanoparticle according to claim 1 wherein the payload is selected from the group consisting of a dye, a sunblock agent, a metallic reflector colloid, and a reflective particle.

3. A nanoparticle according to claim 1 wherein the payload is an unreactive dye.

4. A nanoparticle according to claim 3 wherein the unreactive dye is indigo.

5. A nanoparticle according to claim 1 wherein the payload is mica.

6. A nanoparticle according to claim 1 wherein the payload is a sunblock agent.

7. A denim fabric web comprising payload nanoparticles, the payload nanoparticle comprising an indigo dye entrapped within a polymeric encapsulator and being substantially permanently attached to the fiber of the web by at least one textile- reactive functional group on the surface of the polymeric encapsulator, and wherein the web exhibits a greatly improved colorfastness and resistance to fading.

8. A web comprising a fiberous substrate and payload nanoparticles, the payload nanoparticle comprising a payload entrapped within a transparent or translucent polymeric encapsulator and being substantially permanently attached to the fiber of the web by at least one textile-reactive functional group on the surface of the polymeric encapsulator.

9. A web according to claim 8 wherein the payload is selected from the group consisting of a dye, a sunblock agent, a metallic reflector colloid, and a reflective particle.

10. A web according to claim 8 wherein the payload is mica.

11. A web according to claim 8 wherein the payload is a sunblock agent.

12. A nanoparticle according to claim 1, wherein the payload is selected from the group consisting of bioactive agents, anti-microbial/fungal agents, drugs, pharmaceuticals, sunblock agents, dyes, pigments, scents, fragrances, insect repellents, fire retardant or suppressant chemicals, metallic reflector colloids, reflective particles, magnetic particles, thermochromic materials, heat-absorbing or heat-releasing phase change agents, fabric softeners, zeolites, and activated carbon.

13. A nanoparticle according to claim 1, wherein the polymeric encapsulator exhibits controlled release of the payload.

14. A web according to claim 8, wherein the polymeric encapsulator exhibits controlled release of the payload.

15. A web according to claim 8, wherein the payload is selected from the group consisting of bioactive agents, anti-microbial/fungal agents, drugs, pharmaceuticals, sunblock agents, dyes, pigments, scents, fragrances, insect repellents, fire retardant or suppressant chemicals, metallic reflector colloids, magnetic particles, reflective particles, thermochromic materials, heat-absorbing or heat-releasing phase change agents, fabric softeners, zeolites, and activated carbon; and the web exhibits a greatly improved retention of the payload and its activity.

16. A web according to claim 8, wherein the payload is an unreactive dye and the web exhibits a greatly improved colorfastness and resistance to fading.

17. A web according to claim 8, wherein the payload is an indigo dye.

* * * * *